US009579878B1

(12) United States Patent
Chung et al.

(10) Patent No.: US 9,579,878 B1
(45) Date of Patent: Feb. 28, 2017

(54) GRAVURE PRINTING SYSTEM AND METHOD OF USING THE SAME

(71) Applicant: Industrial Technology Research Institute, Hsinchu (TW)

(72) Inventors: Sheng-Feng Chung, Hsinchu (TW); Cheng-Yi Shih, Hsinchu (TW); Shu-Yi Chang, Kaohsiung (TW); Yu-Jie Wei, Hsinchu (TW); Shih-Ming Lin, Chiayi County (TW); Su-Tsai Lu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 14/927,486

(22) Filed: Oct. 30, 2015

(51) Int. Cl.
*B41F 9/08* (2006.01)
*B41F 9/10* (2006.01)

(52) U.S. Cl.
CPC ..... *B41F 9/10* (2013.01)

(58) Field of Classification Search
CPC ..... B41F 9/10
USPC ..... 101/155
See application file for complete search history.

(56) References Cited

U.S. PATENT DOCUMENTS 4,184,429 A * 1/1980 Widmer ..... B41F 9/1072 101/169
5,023,513 A * 6/1991 Spielvogel ..... C07F 5/027 514/64
5,656,083 A * 8/1997 Schonberger ..... B41F 31/027 101/157
5,823,110 A * 10/1998 Izume ..... B41F 31/04 101/352.09
6,095,045 A * 8/2000 Petersen ..... B41F 31/027 101/350.6

(Continued)

FOREIGN PATENT DOCUMENTS

CN 202180631 4/2012
CN 203254758 10/2013

(Continued)

OTHER PUBLICATIONS

D. Clark et al., "Major Trends in Gravure Printed Electronics," Graphic Communication Department, California Polytechnic State University, Jun. 2010, pp. 1-30.

(Continued)

*Primary Examiner* — Anthony Nguyen
(74) *Attorney, Agent, or Firm* — Jianq Chyun IP Office

(57) ABSTRACT

A gravure printing system is provided. The gravure printing system includes a plate cylinder, an ink source, a cover blade, and a doctor blade. The plate cylinder has a circumferential surface with at least one groove. The ink source is adapted to provider an ink onto the circumferential surface of the plate cylinder. The cover blade is adapted to form an anti-drying layer on the plate cylinder from the ink. The doctor blade is adapted to contact the plate cylinder and fill the at least one groove with the ink. A point on the circumferential surface sequentially passes by the ink source, the cover blade, and the doctor blade as the plate cylinder rotates. A Young's modulus of a material of the cover blade is less than a Young's modulus of a material of the doctor blade. A method of using the gravure printing system is also provided.

21 Claims, 6 Drawing Sheets

(56) References Cited

U.S. PATENT DOCUMENTS

| | | | | |
|---|---|---|---|---|
| 6,523,469 | B2 * | 2/2003 | Bayer | B41F 31/027 101/155 |
| 7,152,526 | B2 * | 12/2006 | Urata | B41F 9/1072 101/157 |
| 7,941,067 | B2 | 5/2011 | Thayer et al. | |
| 8,006,616 | B2 * | 8/2011 | Kleinschnitz | B41F 31/027 101/157 |
| 8,365,663 | B2 * | 2/2013 | Kim | B41F 9/01 101/154 |
| 8,869,695 | B2 * | 10/2014 | Chow | G03G 15/104 101/155 |
| 2002/0079051 | A1 | 6/2002 | McQuaid | |
| 2005/0120893 | A1 * | 6/2005 | Kolbe | B41F 31/04 101/155 |
| 2009/0208661 | A1 * | 8/2009 | Kim | B41F 3/36 427/428.01 |
| 2011/0259220 | A1 * | 10/2011 | Sakata | B41F 9/1081 101/157 |
| 2012/0097059 | A1 * | 4/2012 | Allemand | C09D 11/52 101/483 |

FOREIGN PATENT DOCUMENTS

| | | |
|---|---|---|
| TW | M261957 | 4/2005 |
| TW | 200711850 | 4/2007 |
| TW | I322762 | 4/2010 |

OTHER PUBLICATIONS

Ahmed et al., "Simulation of non-Newtonian ink transfer between two separating plates for gravure-offset printing," International Journal of Heat and Fluid Flow, Jul. 2010, pp. 298-307.

Lee et al., "Development of a gravure offset printing system for the printing electrodes of flat panel display," Thin Solid Films, Oct. 2009, pp. 3355-3359.

Sondergaard et al., "Roll-to-Roll Fabrication of Large Area Functional Organic Materials," Journal of Polymer Science Part B: Polymer Physics, Jan. 2013, pp. 16-34.

Pujun et al., "Influences of Cell Angles on Ink Transferring in Gravure," Proceedings of the 17th IAPRI World Conference on Packaging, Oct. 2010, pp. 177-179.

* cited by examiner

GRAVURE PRINTING SYSTEM AND METHOD OF USING THE SAME

TECHNICAL FIELD

The technical field relates to a gravure printing system and a method of using the same.

BACKGROUND

In conventional gravure printing systems, ink is provided to a cylinder for printing. The cylinder may have grooves that define an engraved pattern. As the cylinder is rotated past a doctor blade pressed against its periphery, the ink is scraped off the cylinder except in the engraved patterned defined by the grooves. This way, the ink is filled into the grooves. The cylinder may then print the ink filled in the engraved pattern onto a substrate. Gravure printing systems may be used in various applications such as printing magazines, cards, or wrapping paper. Gravure printing systems may also be applied to print electronics.

However, during the printing process, evaporation may cause the ink filled in the engraved pattern to become dry. This creates a phenomenon where the dried ink remains in the grooves of the engraved pattern. As the dried ink remains in the grooves of the engraved pattern, the grooves become shallower, which may affect the quality of the pattern that is printed from the grooves. Specifically in the case of printing electronics, if the pattern or lines printed form the grooves have poor quality, the product that is printed may have poor reliability or may be unable to function.

SUMMARY

An exemplary embodiment of the disclosure provides a gravure printing system including a plate cylinder, an ink source, a cover blade, and a doctor blade. The plate cylinder has a circumferential surface with at least one groove, and is adapted to rotate. The ink source is adapted to provide an ink onto the circumferential surface of the plate cylinder. The cover blade is adapted to form an anti-drying layer on the plate cylinder from the ink. The doctor blade is adapted to contact the plate cylinder and fill the at least one groove with the ink. A point on the circumferential surface sequentially passes by the ink source, the cover blade, and the doctor blade as the plate cylinder rotates. A Young's modulus of a material of the cover blade is less than a Young's modulus of a material of the doctor blade.

An exemplary embodiment of the disclosure provides a method of using a gravure printing system. An ink is provided onto a circumferential surface of a plate cylinder through an ink source. The plate cylinder includes at least one groove. An anti-drying layer is formed on the plate cylinder from the ink through a cover blade. The at least one groove is filled with the ink through a doctor blade.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF EMBODIMENTS

Figure 1:
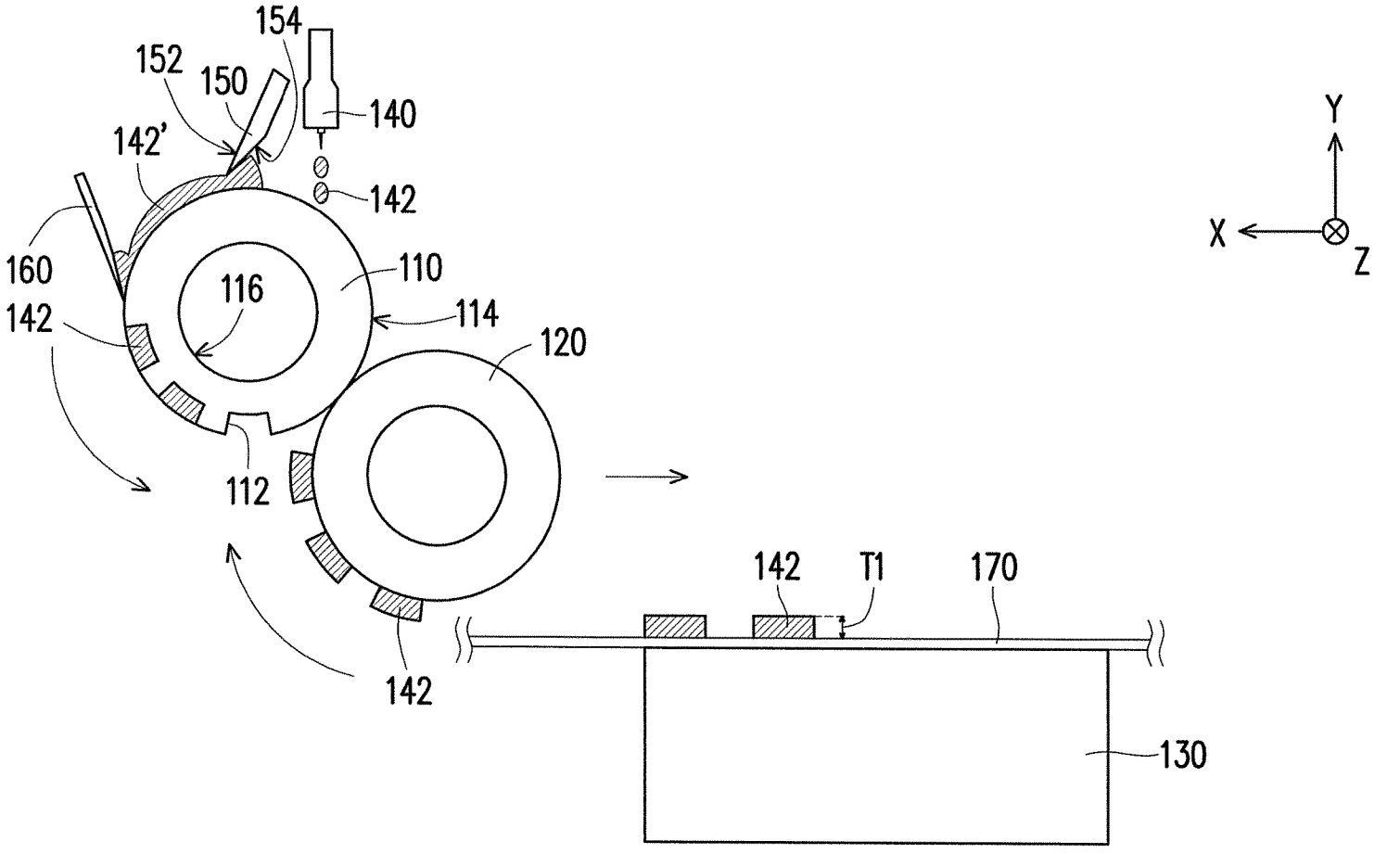
FIG. 1 is a side view of a schematic diagram illustrating a gravure printing system according to an exemplary embodiment.
Figure 2:
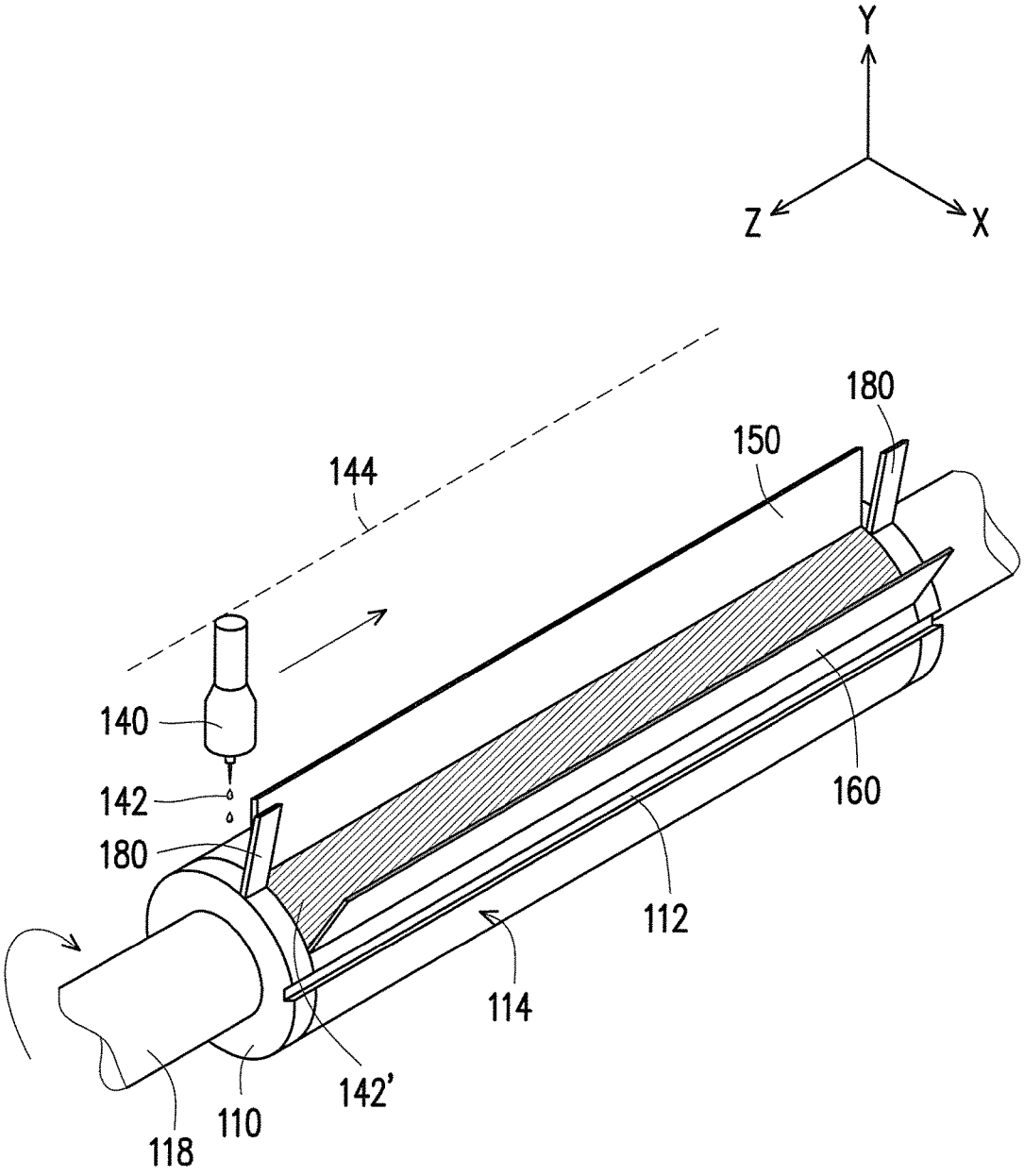
FIG. 2 is a three-dimensional schematic diagram of a portion of the gravure printing system in FIG. 1.

FIG. 1 is a side view of a schematic diagram illustrating a gravure printing system according to an exemplary embodiment. FIG. 2 is a three-dimensional schematic diagram of a portion of the gravure printing system in FIG. 1. In the embodiment, the gravure printing system 100 includes a plate cylinder 110, an ink source 140, a cover blade 150, and a doctor blade 160.

The plate cylinder 110 has a circumferential surface 114 with at least one groove 112, and is adapted to rotate about a shaft 118. The arrow in FIG. 1 shows an exemplary rotational direction of the plate cylinder 110. The number of grooves 112 on the circumferential surface 114 depends on the pattern desired to be printed by the user. In addition, each of the grooves 112 may have different shapes and sizes, and are not limited to be the same. The grooves 112 shown in FIG. 1 and FIG. 2 are for descriptive purposes only. In addition, the plate cylinder 110 has an inner surface 116. The inner surface 116 of the plate cylinder 110 forms the hole for the shaft 118 to pass through. The at least one groove 112 of the plate cylinder 110 defines an engraved pattern that is to be printed on a substrate 170. The grooves 112 can be referred to in FIG. 1, and only one groove 112 is shown in FIG. 2. The circumferential surface 114 of the plate cylinder 110 may be, for example, between $10^1$ to $10^6$ $mm^2$. In the embodiment, a specific example of the plate cylinder 110 may have a length of 520 mm and a diameter of 200 mm, and the surface area of the circumferential surface 114 is $3.27\times10^5$ $mm^2$. A linear velocity of the plate cylinder 110 rotating is, for example, between 1 meter/min and 10 meters/min. That is to say, an angular velocity of the plate cylinder 110 rotating is between 1.59 revolutions per minute (RPM) and 15.9 RPM. A specific example of the rotation speed is, for example, a linear velocity of 3 meters/min and an angular velocity of 4.77 RPM. However, the disclosure is not limited thereto. The size of the plate cylinder 110 may be determined according to the user. Similarly, the rotational speed of the plate cylinder 110 may also be determined according to the user. The parameters above are examples for descriptive purposes only.

The engraved pattern may be, for example, an image, text, or layout design to be printed on the substrate 170. The substrate 170 may be for example, any type of material to be printed on such as paper, glass, or polyethylene terephthalate (PET). Specifically, in the case of glass or PET, the engraved pattern may be metal mesh or layout design for a touch panel. However, the disclosure is not limited thereto. The engraved pattern may be any designed pattern that a user desires to print, and the substrate 170 may be any substrate 170 the user desires the pattern to be printed on.

The ink source 140 is adapted to provide an ink 142 onto the circumferential surface 114 of the plate cylinder 110. This process may be referred to as inking. In the embodiment, the ink source 140 is an ink dispenser adapted to dispense the ink 142 onto the circumferential surface 114 of the plate cylinder 110. The ink source 140 dispenses the ink 142 by moving along a dispensing track 144. The dispensing track 144 extends across a length of the plate cylinder 110. However, in other embodiments, an extension direction of the dispensing track 144 may be designed differently according to the user. An arrow in FIG. 2 shows an exemplary direction of the ink source 140 moving along the dispensing track 144. The ink source 140 may move back and forth, in one direction, or remain still depending on the user. Alternatively, the user may also apply multiple ink sources 140 to dispense ink onto the plate cylinder 110 without a dispensing track. The amount of ink 142 that is dispensed and the frequency of dispensing the ink 142 depend on the requirements of the user. However, the disclosure is not limited thereto. The ink source 140 may also be an ink fountain or any other type of ink provider suitable for the user. In addition, the type of ink 142 that is used for printing may depend on the application of the printed pattern. For example, if the ink 142 is used to print a metal mesh or layout design of a touch panel, the ink 142 will have conductive properties. However, the disclosure is not limited thereto. The ink 142 may be any type of ink 142 suitable or desirable for the user.

Figure 3:
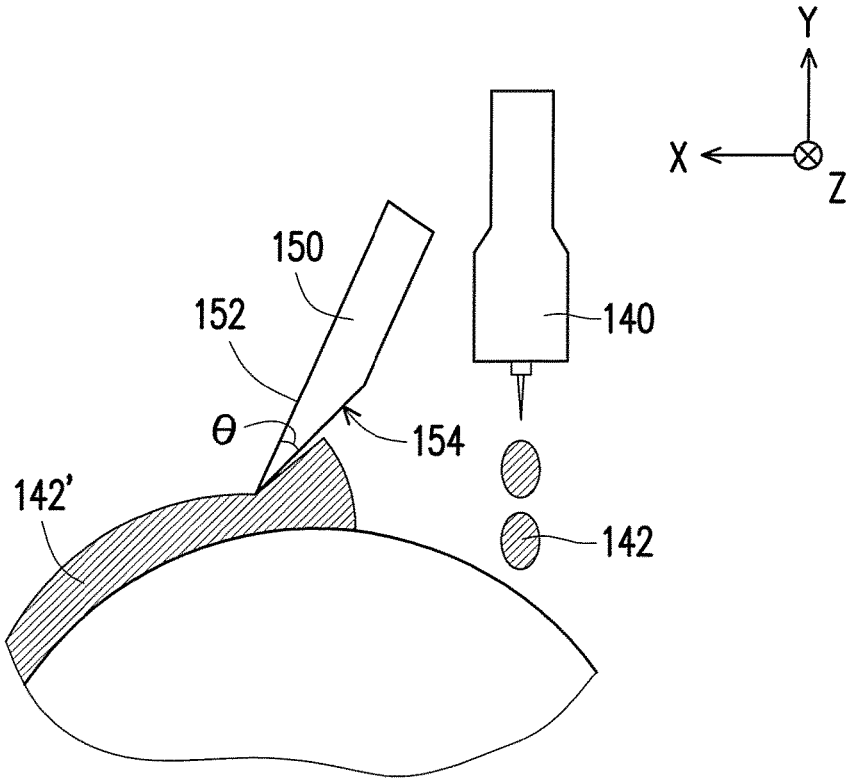
FIG. 3 is a partial enlarged view of the schematic diagram illustrating the gravure printing system in FIG. 1.

FIG. 3 is a partial enlarged view of the schematic diagram illustrating the gravure printing system in FIG. 1. In particular, FIG. 3 shows an enlarged view of the cover blade 150. The cover blade 150 is adapted to form an anti-drying layer 142' on the plate cylinder 110 from the ink 142. The cover blade 150 comprises a flat surface 152 and a sloped surface 154 opposite to the flat surface 152. The sloped surface 154 contacts the plate cylinder 110 as the plate cylinder 110 rotates to form the anti-drying layer 142', and is titled at an angle θ between 15 degrees to 75 degrees with respect to the flat surface 152. The angle θ allows the cover blade 150 to smoothly form the anti-drying layer 142'. A speed of forming the anti-drying layer 142' is, for example, between 1 meter/min and 10 meters/min. That is to say, the speed of forming the anti-drying layer 142' is the same as the rotational speed of the plate cylinder 110. However, the disclosure is not limited thereto. The speed of forming the anti-drying layer 142' may be adjusted according to one of ordinary skill in the art.

In FIG. 1, the sloped surface 154 is not shown to be in contact with the plate cylinder 110. As the ink 142 contacts the sloped surface 154 the cover blade 150 slightly deforms to form the anti-drying layer 142' so that the sloped surface 154 is in contact with the anti-drying layer 142' and the ink 142, and is not in contact with the plate cylinder 110. Initially, prior to the anti-drying layer 142' being formed, the cover blade 150 is in contact with the plate cylinder 110. Although the anti-drying layer 142' and the ink 142 are described with different reference numbers, the material of the anti-drying layer 142' and the ink 142 are the same. The anti-drying layer 142' and the ink 142 are described with different reference numbers for better description to show that the anti-drying layer 142' is an additional layer formed form the ink 142.

The doctor blade 160 is adapted to perform a doctoring process, which is coming into contact with the plate cylinder 110 and filling the at least one groove 112 with the ink 142. That is to say, are the plate cylinder 110 with the anti-drying layer 142' rotates to come into contact with the doctor blade 160, the doctor blade 160 scrapes off the excess ink 142 from the circumferential surface 114 except at the grooves 112. The doctor blade 160 is pressed against the circumferential surface 114, and so the ink 142 from the anti-drying layer 142' can be scraped and filled into the grooves 112. The ink 142 is continuously provided and the plate cylinder 110 continuously rotates during the doctoring process for the all the grooves 112 to be filled with ink 142. At the same time, the cover blade 150 continuously forms and maintains the anti-dry layer 142'. To complete the doctoring process, the cover blade 150 may be lifted up so as to no longer contact the ink 142 or the plate cylinder 110. Furthermore, the ink source 140 may stop providing ink 142. However, the disclosure is not limited thereto. If one of ordinary skill in the art requires additional ink 142 or the anti-drying layer 142' to remain, the cover blade 150 does not have to be lifted up and the ink source 140 does not have to stop providing ink 142. In the embodiment, the cover blade 150 is lifted up and the ink source 140 stops providing ink so that the circumferential surface 114 no longer has any ink 142 on it, and the grooves 112 are filled with the ink. At this point, the doctoring process is complete. A speed of the doctoring process is, for example, between 1 meter/min and 10 meters/min. That is to say, the speed of the doctoring process is the same as the rotational speed of the plate cylinder 110. Since the doctoring process is simultaneous with the process of the cover blade 150 forming the anti-dry layer 142', the speed of the doctoring process may be the same as the speed of forming the anti-dry layer 142'. However, the disclosure is not limited thereto. The speed of the doctoring process may be adjusted according to one of ordinary skill in the art.

As the excess ink 142 is scraped off the circumferential surface 114 by the doctor blade 160, the excess ink 142 may naturally flow towards the ends of the plate cylinder 110. Thus, the gravure printing system 100 may include at least one side blade 180 (two are shown) positioned adjacent to at least one end of the plate cylinder 110. FIG. 1 does not show the side blades 180 in order to clearly show the other elements of the gravure printing system 100. The at least one side blade 180 is adapted to collect excess ink 142 that is flowed to the at least one end of the plate cylinder 110. In the embodiment, two side blades 180 are shown at the two ends of the plate cylinder 110 in FIG. 2. However, the disclosure is not limited thereto. The number of side blades 180 that are used may depend on, for example, the amount of ink 142 provided by the ink source 140 or the size of the plate cylinder 110. One of ordinary skill in the art may adjust the number of side blades 180 that are used according to need. The disclosure does not limit the number of side blades 180.

In addition, a Young's modulus of a material of the cover blade 150 is less than a Young's modulus of a material of the doctor blade 160. To be specific, in the embodiment, a material of the cover blade 150 is rubber and a material of the doctor blade 160 is metal. Therefore, a Young's modulus of the cover blade 150 made of for example, rubber is around 0.02 gigapascals (GPa). A Young's modulus of the doctor blade 160 made of, for example, aluminum is around 70 (GPa). However, the disclosure is not limited thereto. The specific material of the cover blade 150 and the doctor blade 160 may be selected according to one of ordinary skill in the art as long as the Young's modulus of the material of the cover blade 150 is less than the Young's modulus of the material of the doctor blade 160.

In the embodiment, an arc length between a contact point of the cover blade 150 to the plate cylinder 110 and a contact point of the doctor blade 160 to the plate cylinder 110 is substantially between ⅓ to ¼ of the circumference of the circumferential surface 114. The anti-drying layer 142' that is formed covers a continuous portion of the circumferential surface. The continuous portion is substantially between ⅓ to ¼ of a surface area of the circumferential surface. This surface area is in correlation to the positions of the doctor blade 160 and the cover blade 150. The cover blade 150 forms the anti-drying layer 142' from the ink 142, and the doctor blade 160 scrapes the ink 142 from the anti-drying layer 142' off of the circumferential surface 114 and fills the ink 142 into the grooves 112. Thus, the anti-drying layer 142' stops at the point of contact of the doctor blade 160 to the plate cylinder 110. Furthermore, as seen in FIG. 2, the ends of the anti-drying layer 142' does not cover the ends of the plate cylinder 110 in order allow some space for the excess ink to flow to the sides to be collected by the side blades 180. However, the disclosure is not limited thereto. The arc length between the contact point of the cover blade 150 to the plate cylinder 110 and the contact point of the doctor blade 160 to the plate cylinder 110 may be any other suitable length. Similarly, the continuous portion covered by the anti-drying layer 142' may be any suitable surface area.

A point on the circumferential surface 114 sequentially passes by the ink source 140, the cover blade 150, and the doctor blade 160 as the plate cylinder 110 rotates. That is to say, the ink source 140 is positioned to provide ink 142 onto the plate cylinder 110, and as the plate cylinder 110 rotates, the ink 142 is contacted by the cover blade 150. As described above, the cover blade 150 is a relatively soft material such as rubber. Thus, when the ink 142 is contacted by the cover blade 150 as the plate cylinder 110 rotates, the anti-drying layer 142' is formed. The anti-drying layer 142' is a smooth layer of the ink 142 formed by the cover blade 150 that covers the plate cylinder 110.

In the embodiment, the gravure printing system 100 further includes a blanket cylinder 120. The blanket cylinder 120 is adapted to come in contact with the plate cylinder 110 to off the ink 142 in the at least one groove 112 of the plate cylinder 110 onto the blanket cylinder 120 as both the plate cylinder 110 and the blanket cylinder 120 rotate. That is to say, the ink 142 in the at least one groove 142 of the plate cylinder 110 defines the pattern of the engraved pattern. Therefore, once the ink 142 is offed onto the blanket cylinder 120, the ink 142 defining the pattern of the engraved pattern appears on the blanket cylinder 120. In the embodiment, the blanket cylinder 120 and the plate cylinder 110 rotate in opposite directions. The arrows in FIG. 1 shows the blanket cylinder 120 rotates in a direction opposite to the plate cylinder 110. However, additional rollers may be included in the gravure printing system 100 according to one of ordinary skill in the art, and so the blanket cylinder 120 and the plate cylinder 110 may rotate in the same direction. By including the blanket cylinder 120, the gravure printing system 100 may be a gravure offset printing system since the blanket cylinder 120 may be used for offing the ink 142.

After the doctoring process is complete, the offing process to off the ink 142 from each of the grooves 112 to the blanket cylinder 120 is performed. During the offing process, as the ink 142 from the grooves 112 are transferred onto the blanket cylinder 120, some of the ink 142 remains within the grooves 112. For example, 30% of the ink may remain within the grooves 112. The percentage of ink that may remain within the grooves 112 depends on the parameters of the grooves, and is not always 30%. The ink 142 that remains in the grooves 112 are susceptible to evaporation and may dry within the grooves 112. As the dried ink 142 remains in the grooves 112, the grooves 112 become shallower, which may affect the quality of the pattern that is printed from the grooves 112. The lines that are printed with shallower grooves 112 may be broken, non-uniform, or undesirable to the user. Thus, the anti-drying layer 142' that is formed by the cover blade 150 may reduce the amount of evaporation towards the ink 142 remaining in the grooves 112. That is, once the offing process is completed, the ink source 140 continues to provide ink 142 and the anti-drying layer 142' is formed by the cover blade 150. As the grooves 112 rotate past the anti-drying layer 142', the grooves 112 are under the anti-drying layer 142' to prevent the ink 142 in the grooves 112 from drying.

Although the anti-drying layer 142' reduces the evaporation process towards the ink 142 remaining in the grooves 112, the anti-drying layer 142' does not completely prevent the ink 142 from drying in the grooves 112. Once the ink 142 has dried in the grooves 112, the entire printing process must be stopped and the grooves 112 must be cleaned to remove the dried ink 142 in the grooves 112. With the anti-drying layer 142', the printing process can be performed continuously for a longer time before needing to clean the grooves 112.

In the embodiment, the gravure printing system 100 further includes a stage 130. The stage 130 is adapted to carry the substrate 170. The ink 142 from the blanket cylinder 120 is adapted to be set or printed onto the substrate 170. An arrow in FIG. 1 exemplarily shows the direction the blanket cylinder moves 120 to off the ink 142 onto the substrate 170. When setting the ink 142 onto the substrate 170, the blanket cylinder 120 is adapted to roll onto the stage 130 carrying the substrate 170. However, the disclosure is not limited thereto. The gravure printing system 100 may omit the stage 130 and utilize an impression roller (not shown), where the substrate 170 passes between the impression roller and the blanket cylinder 120 to set the ink onto the substrate 170. The substrate 170 passes between the impression roller and the blanket cylinder 120 as the impression roller and the blanket cylinder 120 rotates. One of ordinary skill in the art may select any method of setting the ink 142 onto the substrate 170. The examples above are only for descriptive purposes, and are not meant to limit the disclosure.

In the embodiment, the gravure printing system 100 may be adapted for roll to roll processing. Roll to roll processing is the process of creating, for example, electronic devices on a roll of flexible plastic or metal foil. In particular, in some applications, the substrates are very long, and are manufactured starting as a roll of flexible material, such as large-area flexible displays. Specifically, if a metal mesh or layout design for a touch panel is desired to be printed, the substrate 170 that is rolled up on a roller may be PET, glass, or any other suitable substrate. However, the disclosure is not limited to a roll to roll processing of a touch panel. The gravure printing system 100 may be used in other applications that also have roll to roll processing. The substrate 170 may be of substantial length, and may pass through different systems for different types of processing. Once the processing on the substrate 170 is finished, it may be rolled up on another roller. The gravure printing system 100 is adapted to be one of the systems that the substrate 170 passes through during the roll to roll processing. Although the gravure printing system 100 is adapted for roll to roll processing, the gravure printing system 100 is not limited to only be used in roll to roll processing. The gravure printing system 100 may also be used in printing or inking applications that do not use roll to roll processing.

Figure 4:
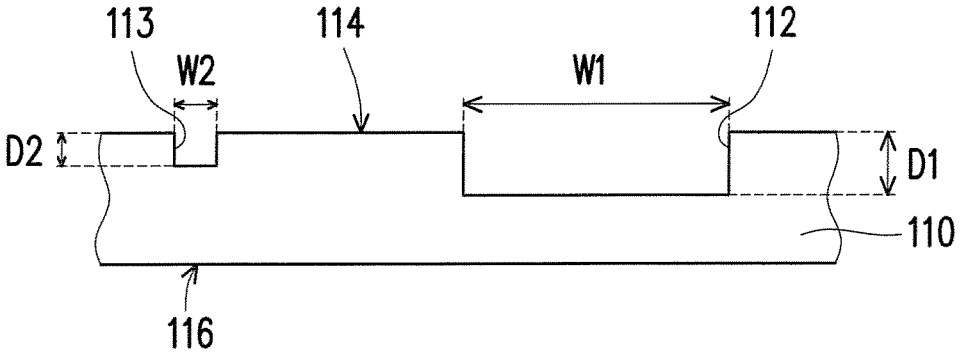
FIG. 4 is a schematic diagram showing a portion of a plate cylinder according to an exemplary embodiment.

FIG. 4 is a schematic diagram showing a portion of a plate cylinder according to an exemplary embodiment. In particular, FIG. 4 provides a close up view of a groove 112 and a groove 113 of the plate cylinder 110 in FIG. 1. The groove 113 is not shown in FIG. 1, and is shown in FIG. 4 for descriptive purposes. The grooves in FIG. 1 and FIG. 4 are not drawn to scale with respect to the plate cylinder 110. Referring to FIG. 4, the groove 112 has a width W1 and a depth D1. The groove 113 has a width W2 and a depth D2. In the embodiment, when forming the grooves 112, 113, the depth of each groove is less than or equal to the width of each groove. That is to say the depth D1 is less than or equal to the width W1, and the depth D2 is less than or equal to the width W2. Specifically, for example, the depth of each groove is half the distance of the width. That is to say, the depth D1 is half the distance of the width W1, and the depth D2 is half the distance of the width W2. In the embodiment, the width W1 is greater than the width W2. Therefore, the depth D1 is able to have a larger distance than the depth D2. In the embodiment, the depth D1 and the depth D2 may be between 1 micrometer to 20 micrometers. Referring to FIG. 1, a thickness T1 is the thickness of the ink 142 that has been set to the substrate 170. Ideally, the thickness T1 of the ink 142 is the same as the depth of the groove. However, as stated before, since some of the ink 142 may remain in the groove during the offing process, the thickness T1 of the ink 142 may be less than the depth of the groove. In the embodiment, the thickness T1 may be between 0.5 micrometers and 20 micrometers. That is to say, the thickness T1 of the ink 142 printed on the substrate 170 is less than or equal to the depth of the groove. The parameters of the depth D1 and the depth D2 and the thickness T1 are examples of printing for specific applications such as the metal mesh or layout design of a touch panel. The patterns that are printed require very thin lines at the micrometer scale. However, the disclosure is not limited thereto. The parameters of the depths of the grooves and the thickness of the ink that is printed may be adjusted according to the parameters desired by a user.

Referring to the parameters described in the embodiment of FIG. 1 and FIG. 4, if the anti-dry layer 142' is not formed, a continuous printing time before the grooves need to be cleaned from dry ink is around 30 minutes. However, when utilizing the anti-dry layer 142', the continuous printing time before the grooves need to be cleaned from dry ink is around 2 hours. It can be seen that the anti-dry layer 142' significantly extends the continuous printing time, further allowing the gravure printing system 100 to be more suitable for roll to roll processing. However, the continuous printing time provided above are merely exemplary, and may change as the parameters of the gravure printing system 100 are adjusted according to the user.

Figure 5:
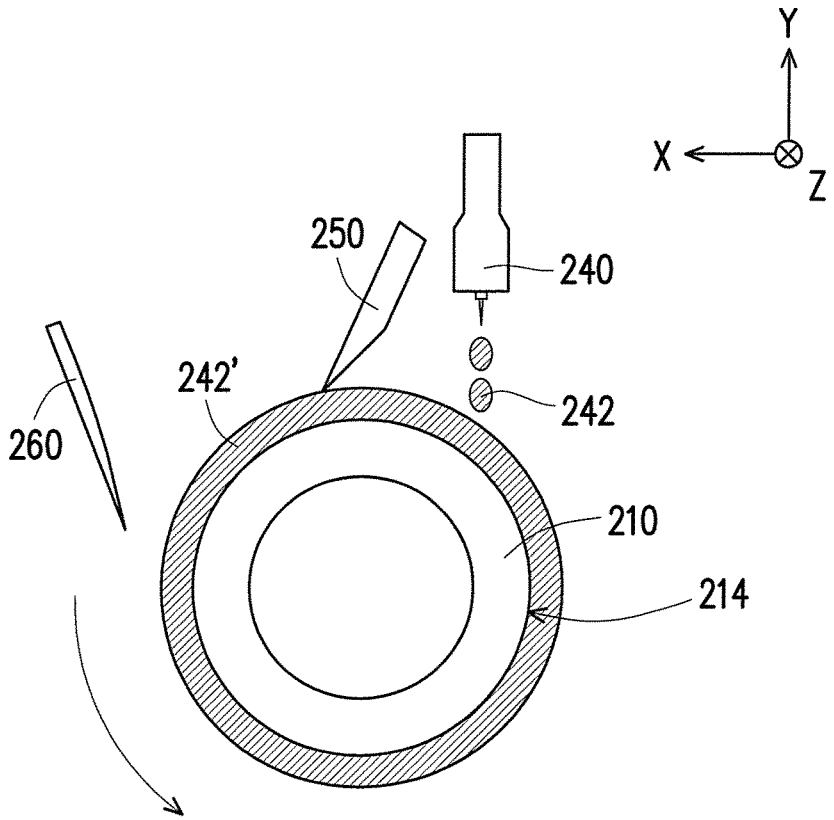
FIG. 5 is a schematic diagram showing a portion of a gravure printing system according to another exemplary embodiment.

FIG. 5 is a schematic diagram showing a portion of a gravure printing system according to another exemplary embodiment. Referring to FIG. 5, FIG. 5 is similar to the embodiment in FIG. 1. The difference is that the anti-dry layer 242' formed by the cover blade 250 substantially completely covers a continuous surface of the circumferential surface 214 of the plate cylinder 210. The anti-dry layer 242' does not completely cover the circumferential surface 214 so that there is some space at the two ends of the plate cylinder 210 for excess ink to flow. However, if a user desires to do so, the entire circumferential surface 214 may be completely covered. When forming the anti-dry layer 242', the doctor blade 260 must be lifted so as to not contact the plate cylinder 210, allowing the anti-dry layer 242' to form. In the embodiment, the process of forming the anti-dry layer 242' and the doctoring process are separate. Therefore, the speeds of each process may be the same or different, as the speeds in each process are independent from the other process.

In comparison with the embodiment of FIG. 1, since the anti-dry layer 242' substantially completely covers a continuous surface of the circumferential surface 214, more ink 242 is required from the ink source 240. That is to say, the embodiment of FIG. 1 requires less ink than the embodiment of FIG. 5, saving significant cost in ink. However, since the anti-dry layer 242' substantially completely covers a continuous surface of the circumferential surface 214, the embodiment of FIG. 5 is more protective of the remaining ink in the grooves from drying. Therefore, the embodiment of FIG. 5 may have a longer continuous printing time than the embodiment of FIG. 1 before needing to clean the grooves. In addition, in comparison of the process time from providing the ink to setting the ink (the TAC time) of the embodiment of FIG. 1 and the embodiment of FIG. 5, the TAC time of FIG. 1 is shorter. This is because the anti-dry layer 142' of FIG. 1 covers a portion of the circumferential surface 114. The time required to cover a portion of the circumferential surface 114 is shorter than the time of the anti-dry layer 242' of FIG. 5 to substantially completely cover a continuous surface of the circumferential surface 214. Using the parameters of FIG. 1 and FIG. 4 as an example, the TAC time of FIG. 1 is around 40 seconds, and the TAC time of FIG. 5 is around 45-50 seconds. The TAC times above a merely exemplary, and can be altered according to user requirements. The TAC times can be anywhere from 1 to 300 seconds.

Based on the above, the anti-dry layer of the gravure printing system assists in reducing the amount of evaporation of the ink remaining in the grooves. That is to say, the ink remaining in the grooves does not dry as quickly when an anti-dry layer is formed. Therefore, the change in the viscosity of the ink may be controlled better with the anti-dry layer, so that the viscosity of the ink may be maintained around the same throughout the printing process.

In addition, with the anti-dry layer, the quality of the patterns or lines printed by the grooves may remain acceptable for a longer continuous printing time. That is to say, since the ink maintains a certain viscosity and are not dried very quickly, the lines or patterns printed out will not be broken or in poor quality. If the gravure printing system is used to print, for example, a metal mesh or layout design of a touch panel, and the line quality is maintained, then the sheet resistance of the final product can be controlled to be around the same.

Figure 6:
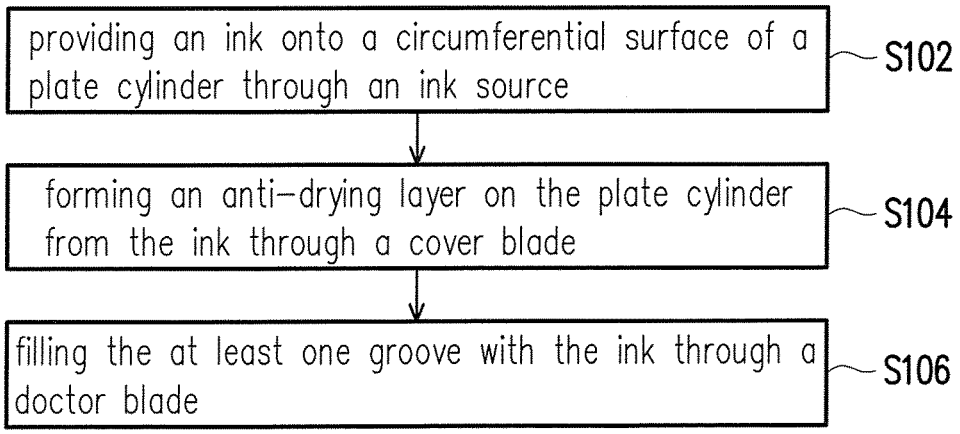
FIG. 6 is a flow chart of a method of using a gravure printing system according to an exemplary embodiment.

FIG. 6 is a flow chart of a method of using a gravure printing system according to an exemplary embodiment. In the embodiment, an ink source provides an ink onto a circumferential surface of a plate cylinder (step S102). The description of the ink source providing the ink can be referred to in the embodiments above, and will not be repeated herein. Next, an anti-drying layer is formed on the plate cylinder from the ink through a cover blade (step S104). The description of forming the anti-drying layer may be referred to in the embodiments above, and will not be repeated herein. Next, the grooves of the plate cylinder are filled with the ink through a doctor blade (step S106). The doctoring process of filling the grooves with ink through a doctor blade may be referred to in the embodiments above, and will not be repeated herein. It should be noted that during that the step S102, the step S104, and the step S106 may initially be sequential during the printing process. As the plate cylinder rotates to continue the printing process, the step S102, the step S104, and the step S106 may occur simultaneously. The sequence of the step S102, the step S104, and the step S106 in the embodiment are only for descriptive purposes, and the method is not limited to the specific sequence.

Figure 7:
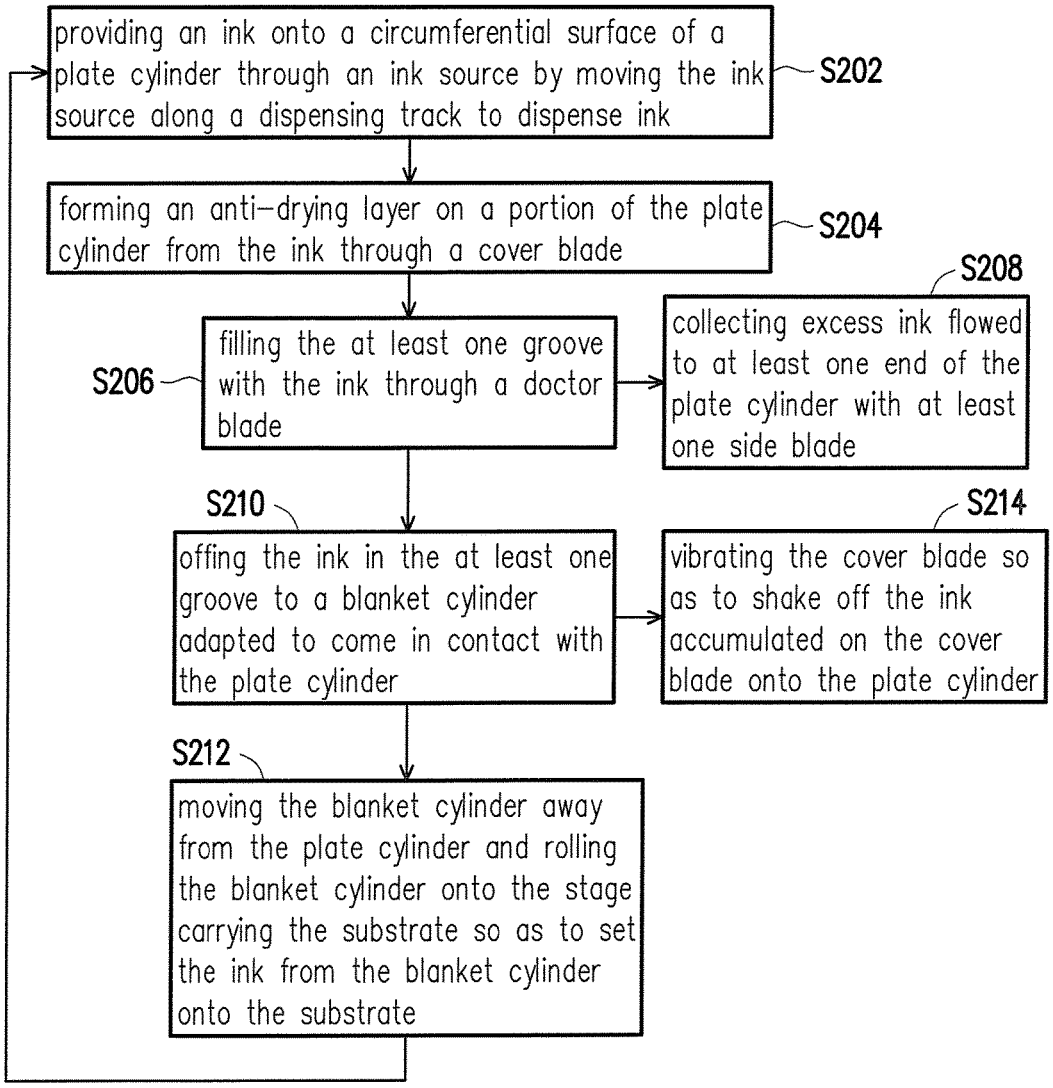
FIG. 7 is a flow chart of a method of using a gravure printing system according to another exemplary embodiment.

FIG. 7 is a flow chart of a method of using a gravure printing system according to another exemplary embodiment. In the embodiment, an ink is provided onto a circumferential surface of a plate cylinder through an ink source by moving the ink source along a dispensing track to dispense ink (step S202). The ink source may be an ink dispenser, and the description of dispensing ink can be referred to in the above embodiments. Next, an anti-drying layer is formed on a portion of the plate cylinder from the ink through a cover blade (step S204). That is to say, step S204 can be referred to in the embodiment of FIG. 1, where the anti-drying layer 142' is formed on a portion of the plate cylinder 110, and does not completely cover the plate cylinder 110. Detailed description can be referred to in the embodiment of FIG. 1. Next, the grooves of the plate cylinder are filled with the ink through a doctor blade (step S206). As the grooves are filled with ink the doctor blade scrapes the excess ink off of the circumferential surface. The excess ink flows to the ends of the plate cylinder. Further description of step S206 may be referred to in the above embodiments, and are not repeated herein. At least one side blade collects the excess ink flowed to at least one end of the plate cylinder (step S208). The side blades continuously collect ink throughout the entire process, and are not limited to collect excess ink after the doctoring process. If there is excess ink flowed towards the side blades during the step S202 or S204, the side blades will continue to collect excess ink. The disclosure is not limited thereto. Next, the inks in the grooves of the plate cylinder are offed to a blanket cylinder adapted to come in contact with the plate cylinder (step S210). The description of offing the ink to the blanket cylinder can be referred to in the above embodiments, and will not be repeated herein. Then, the blanket cylinder is moved away from the plate cylinder and rolled onto the stage carrying the substrate so as to set the ink from the blanket cylinder onto the substrate (step S212). The description of setting the ink onto the substrate can be referred to in the above embodiments, and will not be repeated herein. Then, the cover blade is vibrated so as to shake off the ink accumulated on the cover blade onto the plate cylinder (step S214). As the cover blade forms the anti-dry layer, ink may continually accumulate on the cover blade. Therefore, during step S212, the cover blade that is lifted from the plate cylinder may be vibrated to shake off the ink to drop onto the plate cylinder. Alternatively, the ink accumulated on the cover blade may be removed and provided back onto the plate cylinder manually, or through other suitable methods. The disclosure is not limited thereto. After the step S212 is completed, the method repeats back to step S202. However, it should be noted that the method in FIG. 7 is a continuous printing process, and each of the steps may be performed simultaneously. In addition, the step S202 does not have to wait for step S212 to be completed before repeating. Rather, the step S202 may start again at any suitable step. Similarly, each of the steps S204, S206, S208, S210, and S214 may start again at any suitable time. The sequence disclosed in the method of FIG. 7 are for descriptive purposes only, and the method is not limited to the specific sequence.

Figure 8:
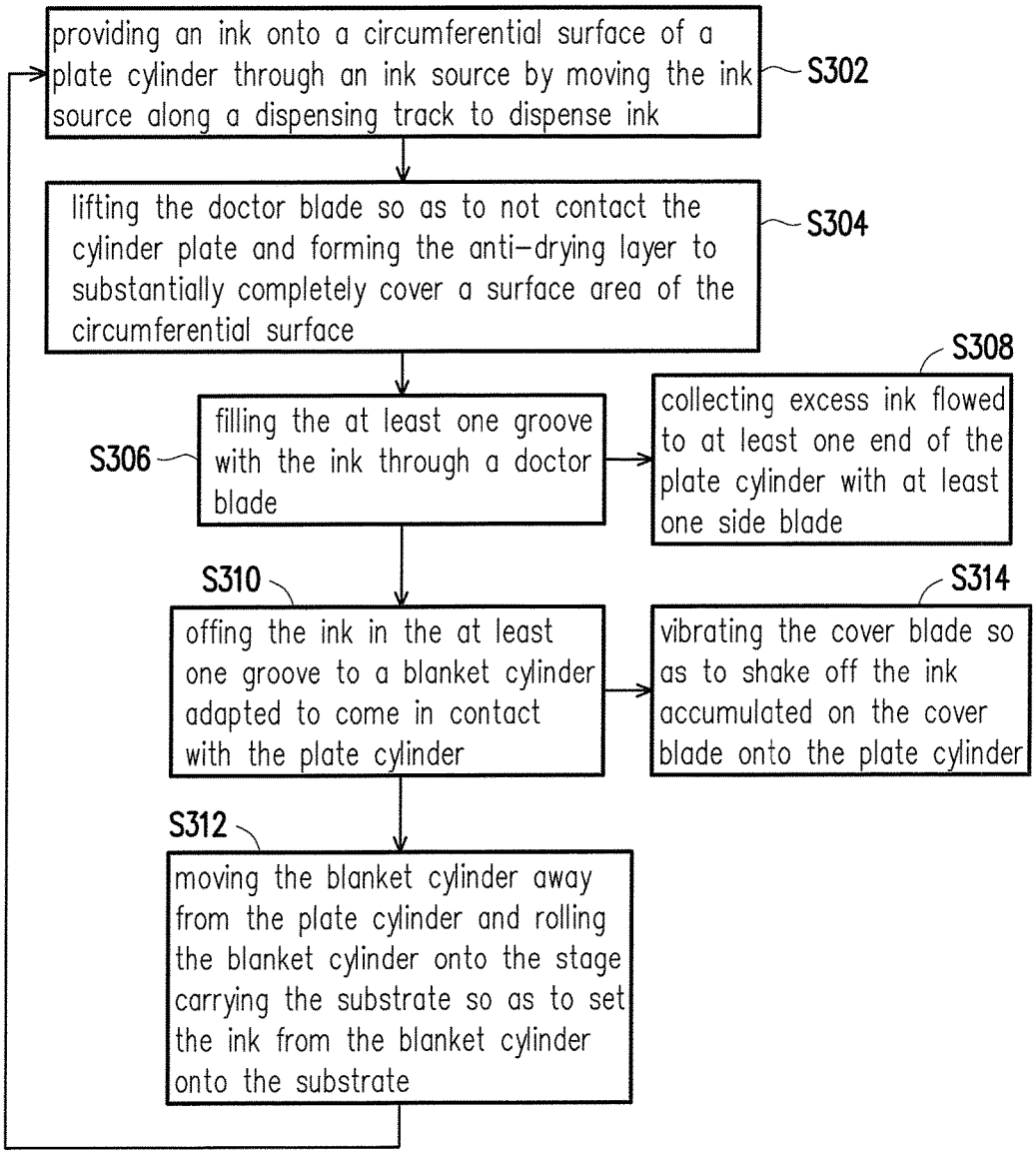
FIG. 8 is a flow chart of a method of using a gravure printing system according to yet another exemplary embodiment.

FIG. 8 is a flow chart of a method of using a gravure printing system according to yet another exemplary embodiment. In the embodiment, an ink is provided onto a circumferential surface of a plate cylinder through an ink source by moving the ink source along a dispensing track to dispense ink (step S302). Next, the doctor blade is lifted so as to not contact the cylinder plate, and the anti-drying layer is formed to substantially completely cover a surface area of the circumferential surface (step S304). That is to say, step S304 can be referred to in the embodiment of FIG. 5, where the anti-drying layer 242' is formed on a portion of the plate cylinder 210, and does not completely cover the plate cylinder 210. Detailed description can be referred to in the embodiment of FIG. 5. Next, the grooves of the plate cylinder are filled with the ink through a doctor blade (step S306). As the grooves are filled with ink the doctor blade scrapes the excess ink off of the circumferential surface. The excess ink flows to the ends of the plate cylinder. At least one side blade collects the excess ink flowed to at least one end of the plate cylinder (step S308). The side blades continuously collect ink throughout the entire process, and are not limited to collect excess ink after the doctoring process. If there is excess ink flowed towards the side blades during the step S302 or S304, the side blades will continue to collect excess ink. The disclosure is not limited thereto. Next, the inks in the grooves of the plate cylinder are offed to a blanket cylinder adapted to come in contact with the plate cylinder (step S310). Then, the blanket cylinder is moved away from the plate cylinder and rolled onto the stage carrying the substrate so as to set the ink from the blanket cylinder onto the substrate (step S312). Then, the cover blade is vibrated so as to shake off the ink accumulated on the cover blade onto the plate cylinder (step S314). The steps S302, S306, S308, S310, S312, and S314 are similar to the embodiment of FIG. 7, and detailed description will not be repeated herein. Furthermore, the sequence disclosed in the method of FIG. 8 are for descriptive purposes only, and the method is not limited to the specific sequence.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A gravure printing system comprising:

a plate cylinder, having a circumferential surface with at least one groove, wherein the plate cylinder is adapted to rotate;

an ink source, adapted to provider an ink onto the circumferential surface of the plate cylinder;

a cover blade, adapted to form an anti-drying layer on the plate cylinder from the ink, wherein a distance is between a distal end of the cover blade facing the circumferential surface of the plate cylinder and the plate cylinder; and a doctor blade, adapted to contact the plate cylinder and fill the at least one groove with the ink, wherein a point on the circumferential surface sequentially passes by the ink source, the cover blade, and the doctor blade as the plate cylinder rotates, and a Young's modulus of a material of the cover blade is less than a Young's modulus of a material of the doctor blade.

2. The gravure printing system as claimed in claim 1, further comprising:

a blanket cylinder, adapted to come in contact with the plate cylinder to off the ink in the at least one groove onto the blanket cylinder; and a stage, adapted to carry a substrate, wherein the blanket cylinder is adapted to roll onto the stage when setting the ink onto the substrate.

3. The gravure printing system as claimed in claim 1, wherein an arc length between a contact point of the cover blade to the plate cylinder and a contact point of the doctor blade to the plate cylinder is substantially between ⅓ to ¼ of the circumference of the circumferential surface.

4. The gravure printing system as claimed in claim 1, wherein the at least one groove of the plate cylinder comprises a depth and a width, and the depth is less than or equal to the width.

5. The gravure printing system as claimed in claim 1, wherein the cover blade comprises a flat surface and a sloped surface opposite to the flat surface, wherein the sloped surface contacts the plate cylinder to form the anti-drying layer, and the sloped surface is formed at an angle between 15 degrees to 75 degrees with respect to the flat surface.

6. The gravure printing system as claimed in claim 1, wherein the anti-drying layer covers a portion of the circumferential surface, wherein the portion is substantially between ⅓ to ¼ of a surface area of the circumferential surface.

7. The gravure printing system as claimed in claim 1, wherein the anti-drying layer substantially completely covers a surface area of the circumferential surface.

8. The gravure printing system as claimed in claim 1, further comprising:

at least one side blade positioned adjacent to at least one end of the plate cylinder, wherein the at least one side blade is adapted to collect excess ink flowed to the at least one end of the plate cylinder.

9. The gravure printing system as claimed in claim 1, wherein the gravure printing system is adapted for roll to roll processing.

10. The gravure printing system as claimed in claim 1, wherein a material of the cover blade is rubber and a material of the doctor blade is metal.

11. A method of using a gravure printing system comprising:

providing an ink onto a circumferential surface of a plate cylinder through an ink source, wherein the plate cylinder comprises at least one groove;

forming an anti-drying layer on the plate cylinder from the ink through a cover blade, wherein a distance is between a distal end of the cover blade facing the circumferential surface of the plate cylinder and the plate cylinder; and filling the at least one groove with the ink through a doctor blade.

12. The method as claimed in claim 11, further comprising:

offing the ink in the at least one groove to a blanket cylinder adapted to come in contact with the plate cylinder; and setting the ink from the blanket cylinder to a substrate.

13. The method as claimed in claim 11, wherein a point on the circumferential surface sequentially passes by the ink source, the cover blade, and the doctor blade as the plate cylinder rotates.

14. The method as claimed in claim 11, wherein a Young's modulus of a material of the cover blade is less than a Young's modulus of a material of the doctor blade.

15. The method as claimed in claim 11, wherein the step of forming the anti-drying layer on the plate cylinder through the cover blade comprises:

forming the anti-drying layer to cover a portion of the circumferential surface, wherein the portion is substantially between ⅓ to ¼ of a surface area of the circumferential surface.

16. The method as claimed in claim 11, further comprising:

collecting excess ink flowed to at least one end of the plate cylinder with at least one side blade positioned adjacent to the at least one end of the plate cylinder.

17. The method as claimed in claim 11, wherein the method of using a gravure printing system is adapted for roll to roll processing.

18. The method as claimed in claim 11, wherein in the step of setting the ink from the blanket cylinder to the substrate, the substrate is adapted to be carried on a stage, and the step further comprises:

moving the blanket cylinder away from the plate cylinder after offing the ink onto the blanket cylinder; and rolling the blanket cylinder onto the stage carrying the substrate so as to set the ink from the blanket cylinder onto the substrate.

19. The method as claimed in claim 11, wherein the step of providing the ink comprises:

moving the ink source along a dispensing track to dispense ink, wherein the dispensing track extends across a length of the plate cylinder.

20. The method as claimed in claim 11, wherein an arc length between a contact point of the cover blade to the plate cylinder and a contact point of the doctor blade to the plate cylinder is substantially between ⅓ to ¼ of the circumference of the circumferential surface.

21. The method as claimed in claim 11, wherein the cover blade comprises a flat surface and a sloped surface opposite to the flat surface, wherein the sloped surface contacts the plate cylinder to form the anti-drying layer, and the sloped surface is formed at an angle between 15 degrees to 75 degrees with respect to the flat surface.

* * * * *